US006511366B1

(12) United States Patent
Liao et al.

(10) Patent No.: US 6,511,366 B1
(45) Date of Patent: Jan. 28, 2003

(54) ROTARY WOODWORKING MACHINE

(76) Inventors: Juei-Seng Liao, No. 295, Sec. 1, Nanking E. Rd., Taichung City (TW); Pei-Lieh Chiang, No. 12, Nan-Ping Rd., Nan Dist., Taichung City (TW)

( * ) Notice: Subject to any disclaimer, the term of this patent is extended or adjusted under 35 U.S.C. 154(b) by 0 days.

(21) Appl. No.: 10/214,840

(22) Filed: Aug. 7, 2002

(30) Foreign Application Priority Data

Jun. 13, 2002 (TW) ..... 91208832 U

(51) Int. Cl.[7] ..... B24B 7/00

(52) U.S. Cl. ..... 451/65; 451/178; 451/299; 451/461

(58) Field of Search ..... 451/65, 66, 178, 451/231, 296, 299, 461, 411

(56) References Cited

U.S. PATENT DOCUMENTS 2,948,088 A * 8/1960 Jepson
3,879,896 A * 4/1975 Maxfiled et al.
5,168,656 A * 12/1992 Jolly et al.
5,806,369 A * 9/1998 Takenaka et al. ..... 74/116
6,095,906 A * 8/2000 Wang ..... 451/65
6,244,228 B1 * 6/2001 Kuhn et al. ..... 123/90.1
6,386,958 B1 * 5/2002 Wang ..... 451/65

* cited by examiner

*Primary Examiner*—Eileen P. Morgan
(74) *Attorney, Agent, or Firm*—Christie, Parker & Hale, LLP

(57) ABSTRACT

A rotary woodworking machine includes an upright shaft rotatable relative to a plunger and driven by a rotary transmitting shaft which is driven by an output shaft of a motor. A lifting lever has a fulcrum end pivoted on a support frame, and a force end coupled to the output shaft by means of a cam member such that a drive force of the output shaft is transmitted to effectuate reciprocating upward and downward movements of the force end. The upward movement of the force end will cause an intermediate weight portion of the lever to lift the upright shaft as well as the plunger from a lower position to a higher position.

9 Claims, 7 Drawing Sheets

ROTARY WOODWORKING MACHINE

CROSS-REFERENCE TO RELATED APPLICATION

This application claims priority of Taiwanese Application No. 091208832, filed on Jun. 6, 2002.

BACKGROUND OF THE INVENTION

1. Field of the Invention

This invention relates to a rotary woodworking machine, more particularly to a rotary woodworking machine with a rotary upright shaft which can effectuate reciprocating upward and downward movements by means of a cam mechanism during rotation.

2. Description of the Related Art

Referring to FIG. 1, a conventional upright wood grinding machine 10 is shown to include a grinding unit 11, a linear motion actuating unit 12, and a transmitting unit 13. The grinding unit 11 includes a hollow cylinder 111, an upright shaft 112 which has an upper end extending through the cylinder 111, and a sanding drum 113 which is mounted on the upper end of the upright shaft 112. The linear motion actuating unit 12 includes a cam wheel 121 and a cam follower 122 which couples the cam wheel 121 to the cylinder 111. The transmitting unit 13 includes a motor 131 with an output shaft 132, a first belt 133 which couples the upright shaft 112 to the output shaft 132 such that a drive force of the output shaft 132 is transmitted to rotate the upright shaft 112, and a second belt 134 which couples the cam wheel 121 to the output shaft 132 such that the drive force of the output shaft 132 is transmitted to rotate the cam wheel 121, thereby effectuating reciprocating upward and downward movements of the cylinder 111 so as to permit the sanding drum 113 to grind a workpiece.

However, as the actuating force of the cam follower 122 is applied to a lateral side of the cylinder 111, the cylinder 111 will deflect during the reciprocating movements and will obstruct the linear movement of the upright shaft 112. Moreover, it is desirable to have a rotary woodworking machine that is provided with a plurality of woodworking members in addition to the sanding drum.

SUMMARY OF THE INVENTION

The object of the present invention is to provide a rotary woodworking machine which can smoothly and steadily effectuate reciprocating upward and downward movements of an upright shaft when the upright shaft is rotated.

According to this invention, the rotary woodworking machine includes a linear motion stabilizing member which has top and bottom ends opposite to each other in an upright direction to define a guideway therebetween. A plunger is slidable along the guideway between higher and lower positions, and has an upper end proximate to the top end. An upright shaft extends along an upright axis in the upright direction, and includes a lower anchoring portion which is mounted to and which is rotatable relative to the upper end about the upright axis, an intermediate portion which extends uprightly from the lower anchoring portion and which has lifted and coupled segments respectively proximate to and distal from the lower anchoring portion, and an upper mounting portion which extends uprightly from the coupled segment. A lifting force receiving member has a pushed end which is disposed proximate to the lower anchoring portion and which permits the lifted segment to be rotatable relative thereto, and a securing end which is opposite to the pushed end in the upright direction and which is rotatable relative to the pushed end so as to be rotated with the lifted segment. A motor has an output shaft for delivering a drive force. A lifting lever includes a fulcrum end pivotally mounted on a support frame about a pivot axis transverse to the upright axis, a force end opposite to the fulcrum end, and a weight portion interposed between the fulcrum end and the force end. A cam member is coupled to the output shaft and the force end such that the drive force of the output shaft is transmitted to effectuate reciprocating upward and downward movements of the force end in the upright direction. The upward movement of the force end causes the weight portion to push against the pushed end so as to lift the lifted segment as well as the plunger from the lower position to the higher position. A transmitting shaft is journalled on the support frame, and is driven by the drive force to rotate about an axis which is transverse to the upright axis and the pivot axis. The transmitting shaft includes a coupling segment to couple with the coupled segment such that the rotation of the transmitting shaft is transmitted to rotate the coupled segment when the lifted segment is moved between the lower and higher positions.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
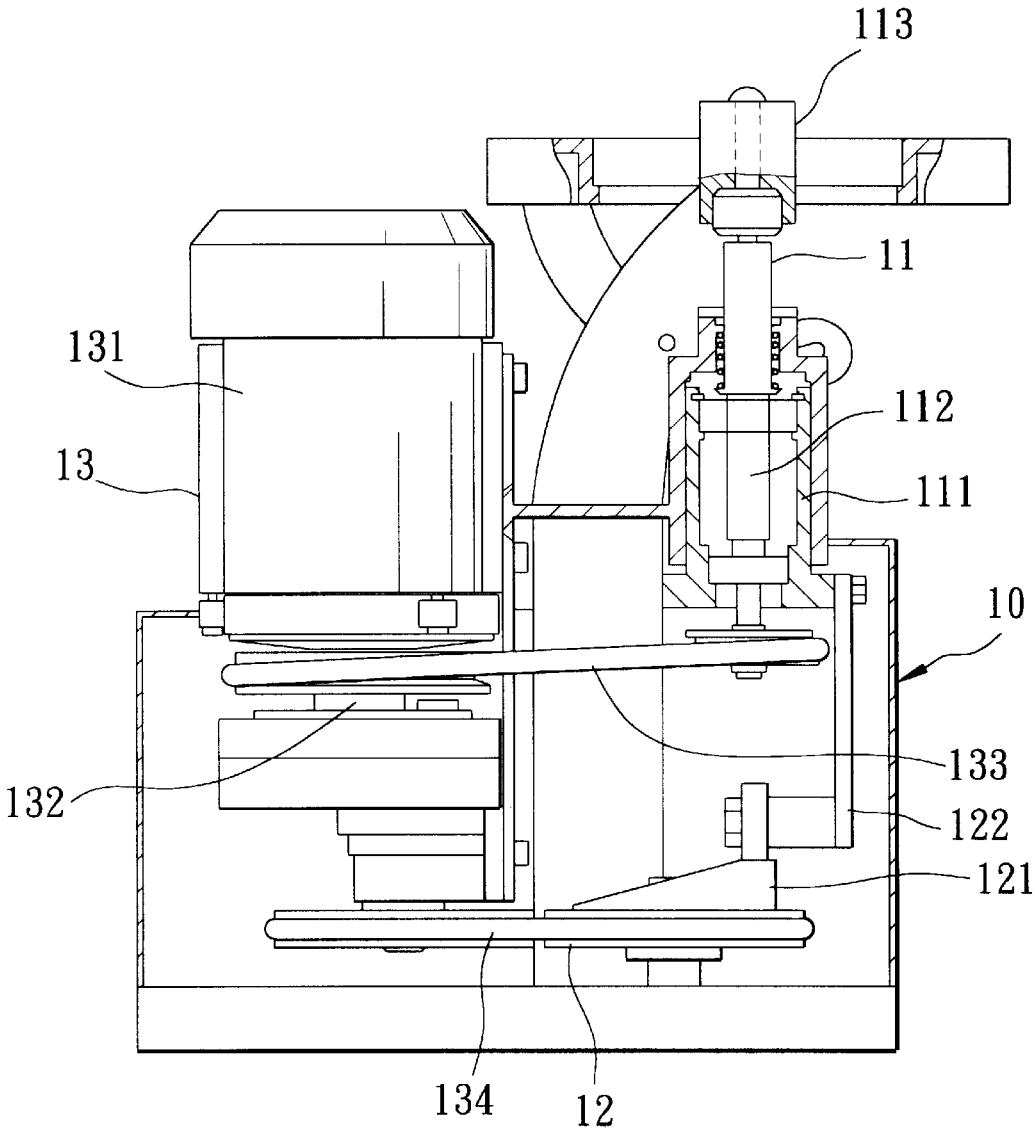
FIG. 1 PRIOR ART
FIG. 1 is a partly sectional view of a conventional upright wood grinding machine.
Figure 2:
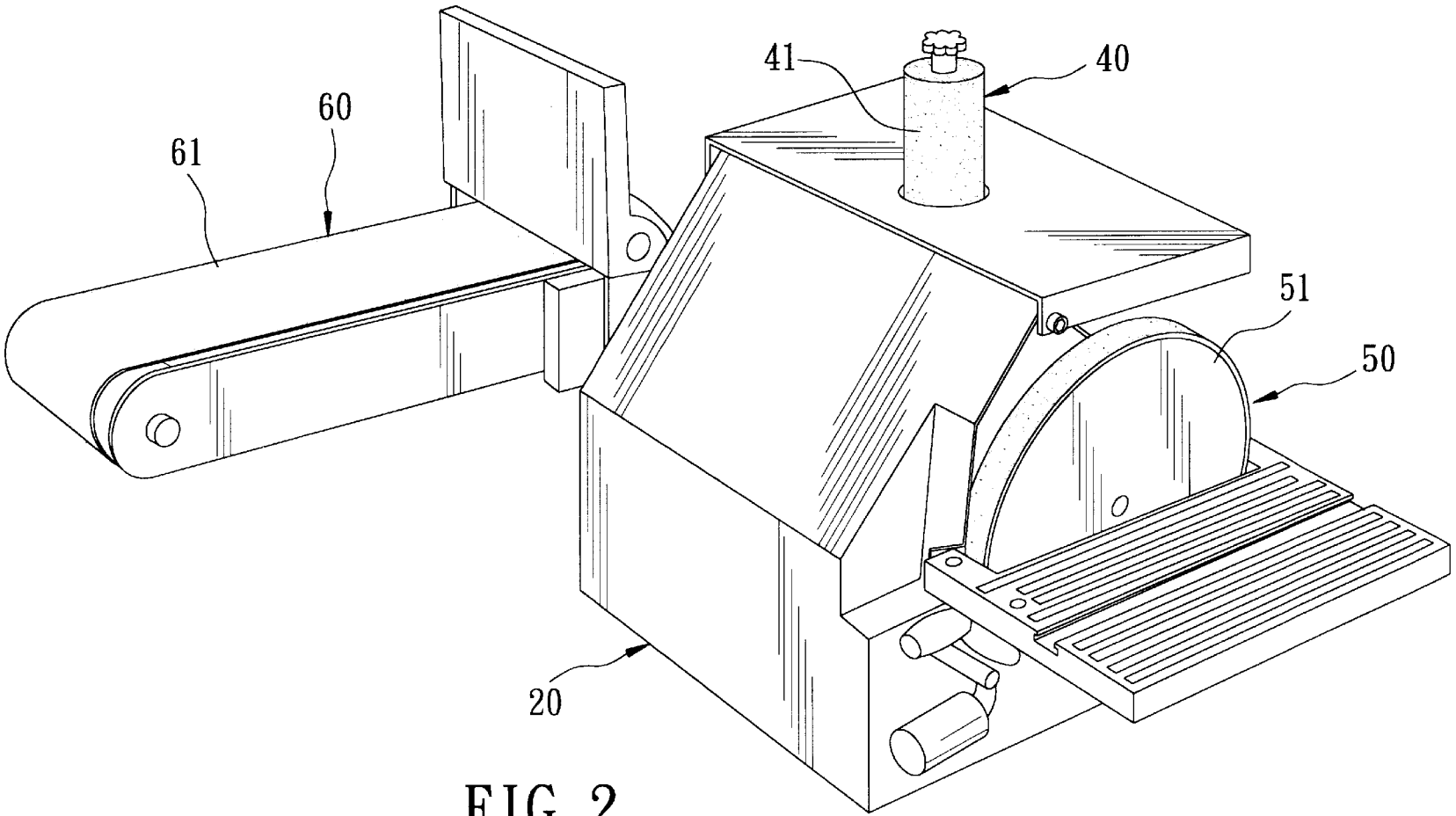
FIG. 2 is a perspective view of a preferred embodiment of a rotary woodworking machine according to this invention.

Referring to FIGS. 2 to 5, the preferred embodiment of a rotary woodworking machine according to the present invention is shown to comprise a support frame 20, a drive transmission mechanism 30 mounted to the support frame 20, and first, second and third rotary woodworking members 50,60,40. The first, second and third rotary woodworking members respectively have an emery wheel 51, a sand-belt 61, and a sanding drum 41.

The drive transmission mechanism 30 includes a motor 33 with an output shaft 331 for delivering a drive force. A transmitting shaft 32 is journalled on the support frame 20, and is disposed to be driven by the drive force so as to rotate about a first axis. The transmitting shaft 32 has an intermediate coupling segment 35 in the form of an outer threaded surface, and opposite first and second ends which extend outwardly of the support frame 20 such that the first and second rotary woodworking members 50,60 are respectively coupled to and are rotated with the first and second ends.

An upright shaft 31 extends along an upright axis in an upright direction which is transverse to the first axis, and has an intermediate portion which includes a coupled segment 34 in the form of an outer threaded surface so as to frictionally engage the coupling segment 35 such that the rotation of the transmitting shaft 32 can be transmitted to rotate the upright shaft 31 by means of engagement of the coupling and coupled segments 35,34. The upright shaft 31 further has an upper mounting portion 311 which extends uprightly from the coupled segment 34 and outwardly of the support frame 20 such that the third rotary woodworking member 40 is coupled to and is rotated with the upper mounting portion 311.

Figure 4:
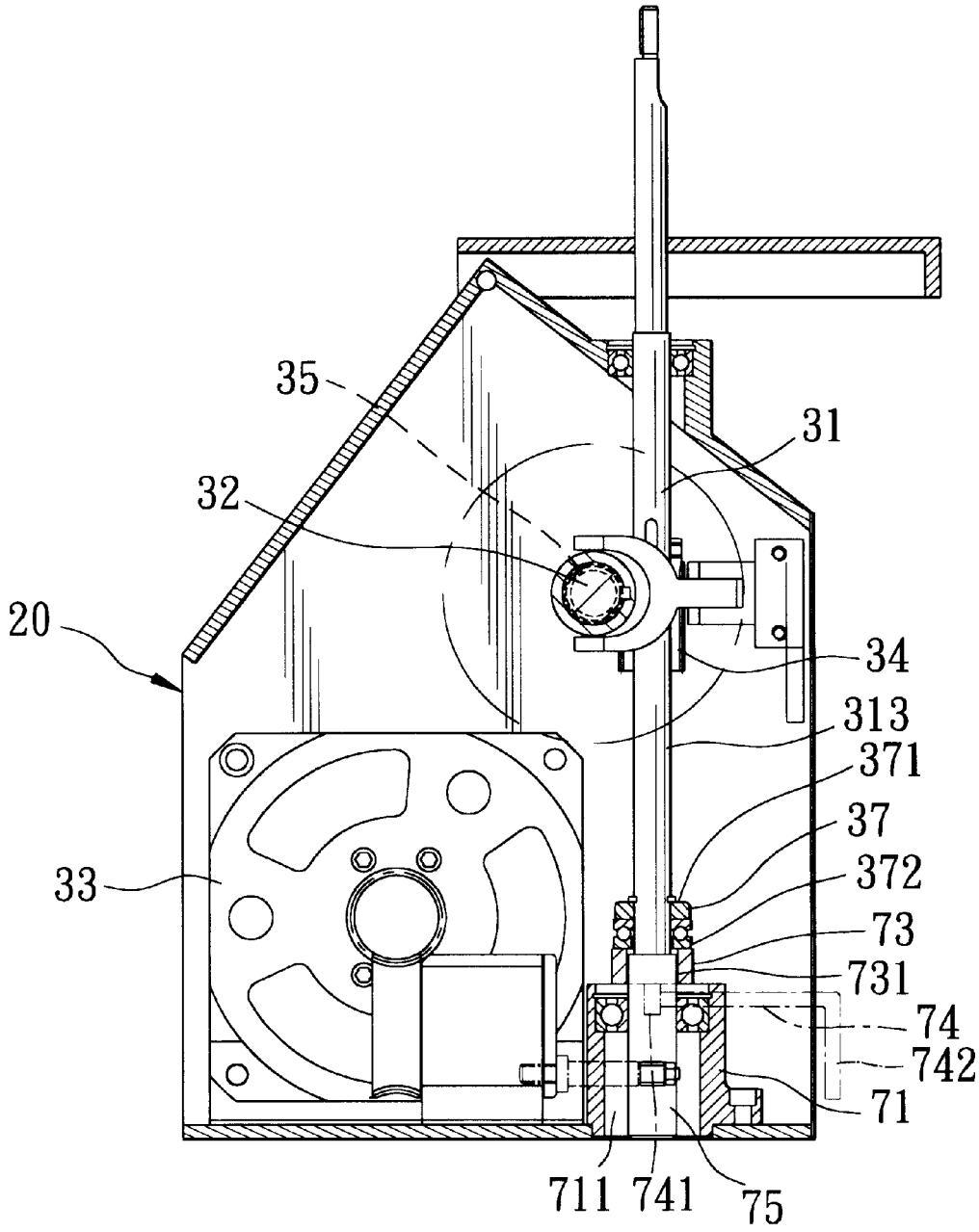
FIG. 4 is a partly sectional view of the preferred embodiment taken from a lateral side thereof.
Figure 5:
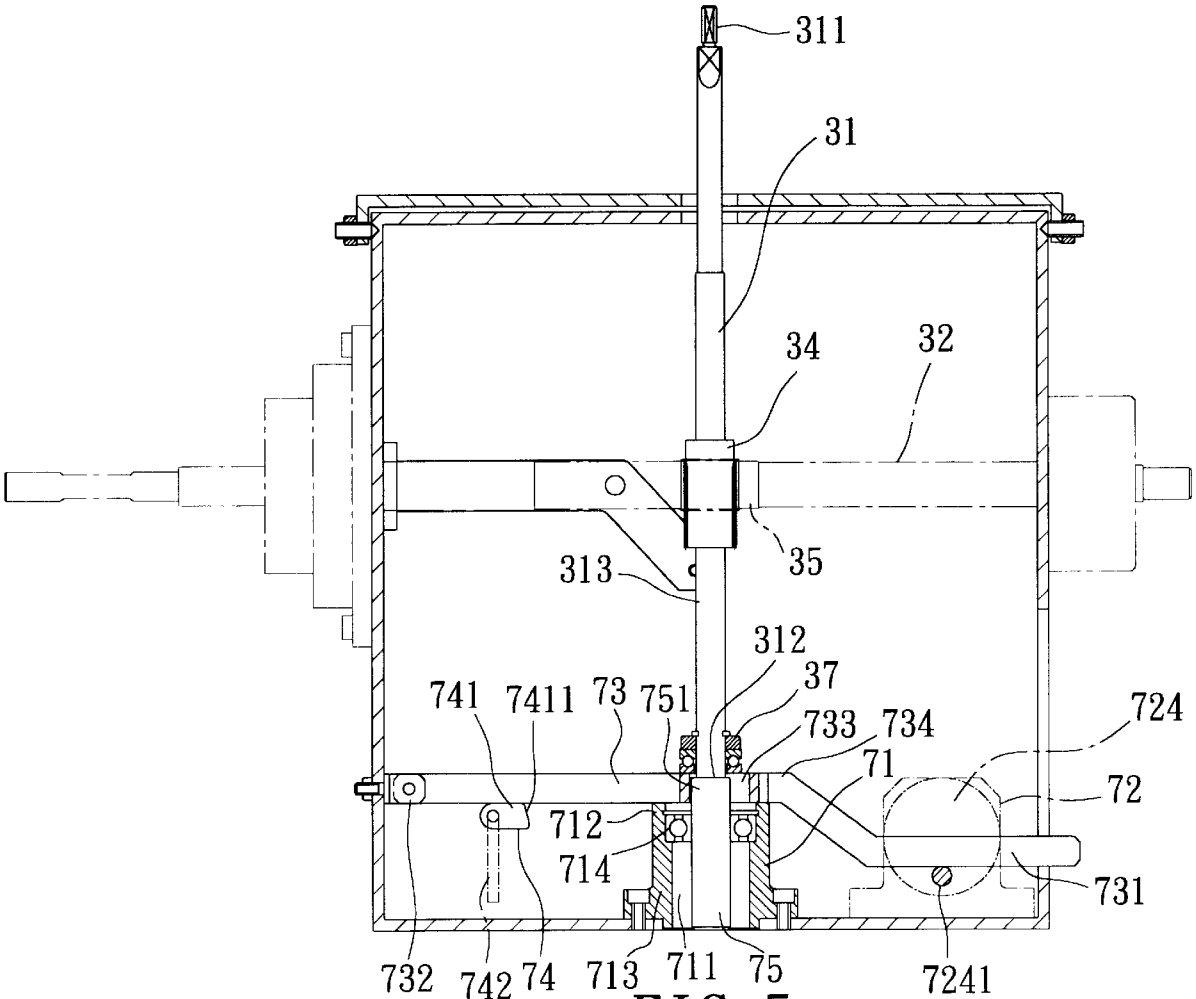
FIG. 5 is a partly sectional view of the preferred embodiment taken from a rear side thereof.

With reference to FIGS. 4 and 5, a linear motion stabilizing member 71 is secured on the support frame 20, and includes top and bottom ends 712,713 opposite to each other in the upright direction to define a guideway 711 therebetween. An anti-friction bearing 714 is disposed on the linear motion stabilizing member 71 adjacent to the top end 712. A plunger 75 is disposed to be slidable along the guideway 711 between higher and lower positions, and has an upper end 751 proximate to the top end 712.

The upright shaft 31 has a lower anchoring portion 312 which is mounted to and which is rotatable relative to the upper end 751 of the plunger 75 about the upright axis. The intermediate portion of the upright shaft 31 extends uprightly from the lower anchoring portion 312, and has a lifted segment 313 proximate to the lower anchoring portion 312.

A lifting force receiving member 37 has a pushed end 372 which is disposed proximate to the lower anchoring portion 312 and which permits the lifted segment 313 to be rotatable relative thereto, and a securing end 371 which is opposite to the pushed end 372 in the upright direction, and which is rotatable relative to the pushed end 372 so as to be rotated with the lifted segment 313. In this embodiment, the lifting force receiving member 37 is a bearing which has lower and upper races that serve as the pushed end 372 and the securing end 371, respectively.

Figure 3:
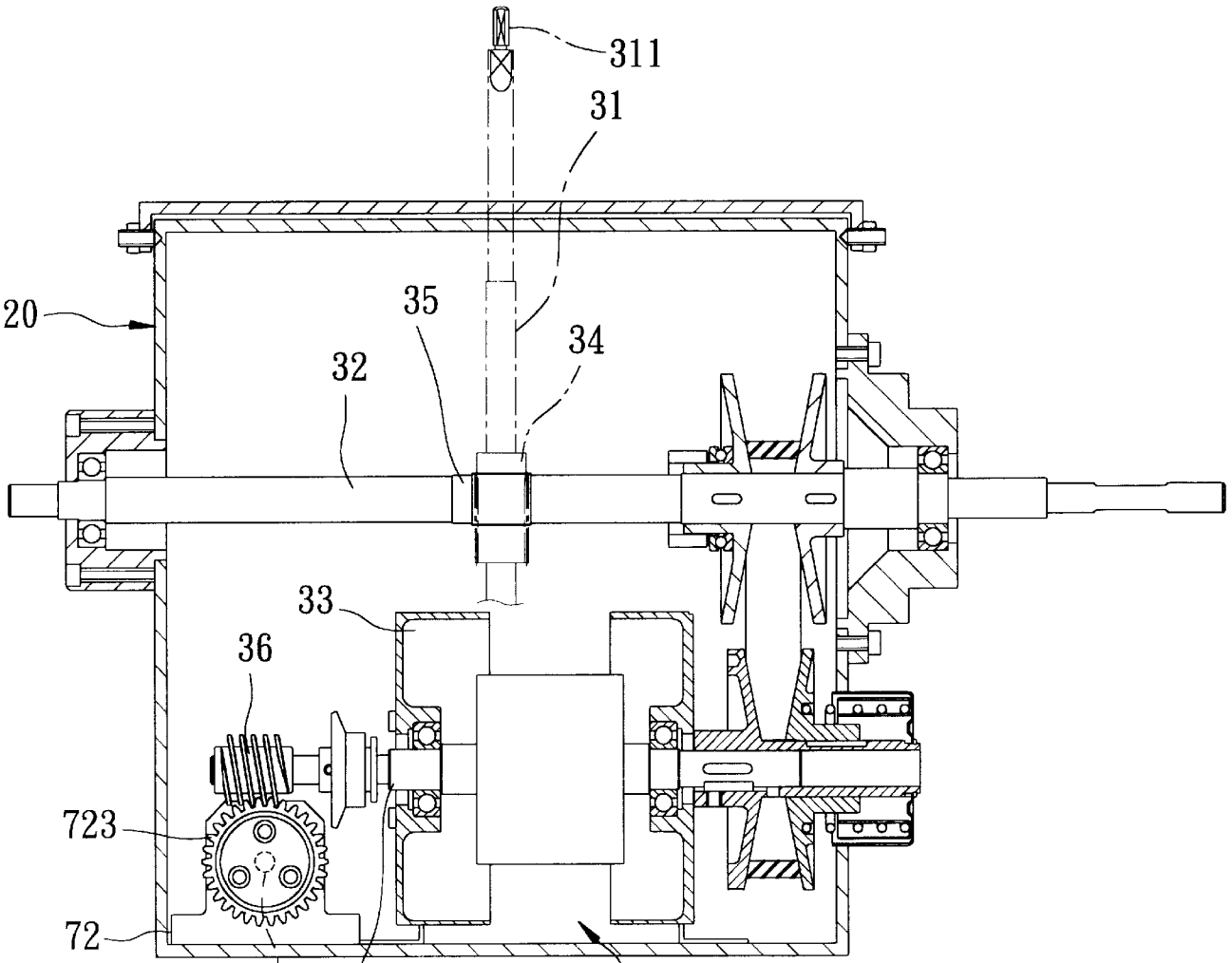
FIG. 3 is a partly sectional view of the preferred embodiment taken from a front side thereof.

As shown in FIGS. 3 and 5, a coupling gear unit includes a worm gear 36 which is mounted on and which is rotated with the output shaft 331, a support seat 72 which is mounted on the support frame 20, a rotating shaft 722 which extends along a second axis that is transverse to the upright axis and the first axis and which has first and second shaft ends, and a toothed wheel 723 which is mounted on the first shaft end.

A cam member includes a cam wheel 724 which is mounted on the second shaft end of the rotating shaft 722 and which has a protrusion 7241 formed eccentrically thereon. The toothed wheel 723 meshes with the worm gear 36 to rotate the rotating shaft 722 and the cam wheel 724 about the second axis.

A lifting lever 73 includes a fulcrum end 732 which is pivotally mounted on the support frame 20 about a pivot axis parallel to the second axis, a force end 731 opposite to the fulcrum end 732, and a weight portion 734 which is interposed between the fulcrum end 732 and the force end 731 and which has a through hole 733 for passage of the plunger 75 therethrough. The force end 731 has a lower surface which abuts against the protrusion 7241 so as to serve as a cam follower.

Figure 6:
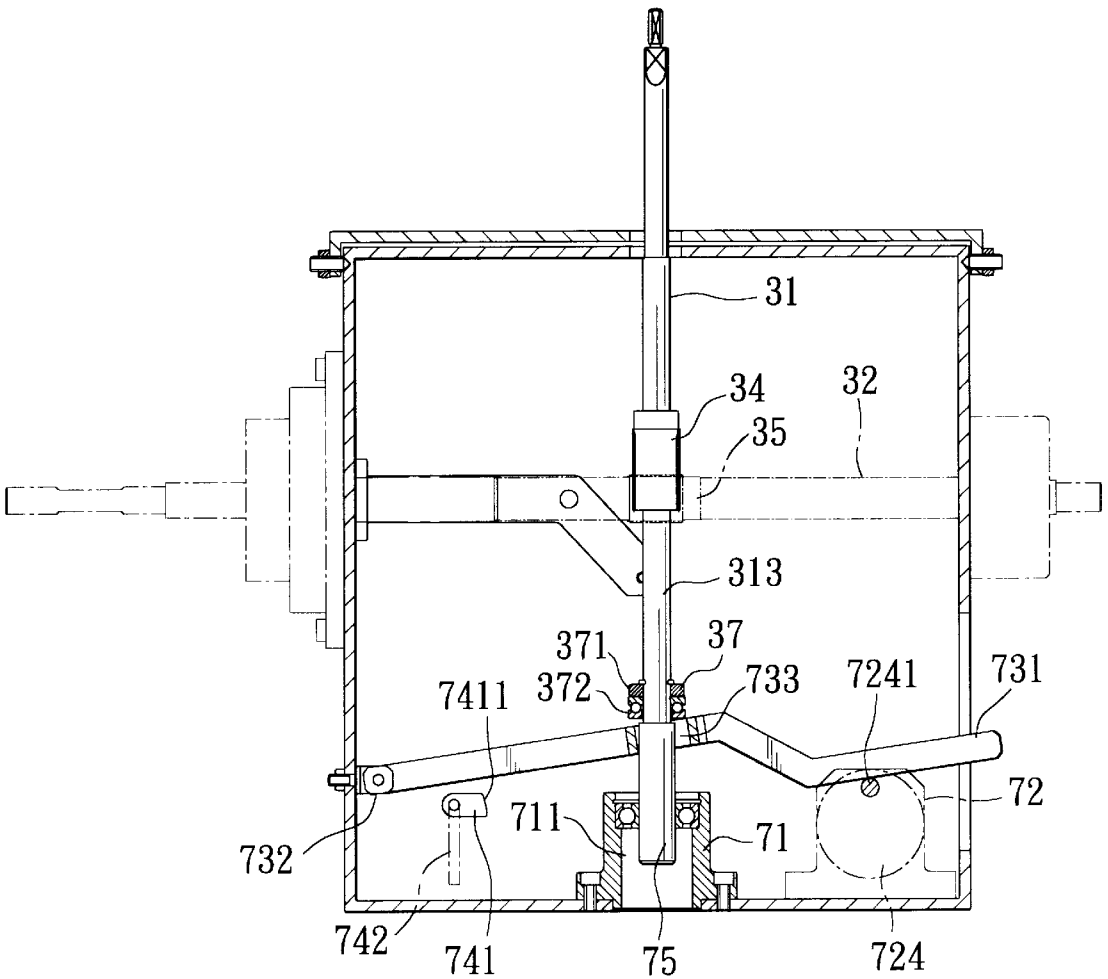
FIG. 6 is a view similar to FIG. 5 but showing the preferred embodiment in a state where a lifting lever is lifted to a higher position.

As such, with reference to FIGS. 5 and 6, when the drive force of the output shaft 331 (see FIG. 3) is transmitted by the coupling gear unit to rotate the cam wheel 724 about the second axis, the force end 731 of the lifting lever 73 is guided by the cam wheel 724 and the cam follower to perform reciprocating upward and downward movements in the upright direction. Thus, the upward movement of the force end 731 will cause the weight portion 734 to push against the pushed end 372 of the lifting force receiving member 37 so as to lift the lifted segment 313 as well as the plunger 75 from the lower position to the higher position. Note that the engagement of the coupling and coupled segments 35,34 is maintained when the lifted segment 313 is moved between the lower and higher positions.

Figure 7:
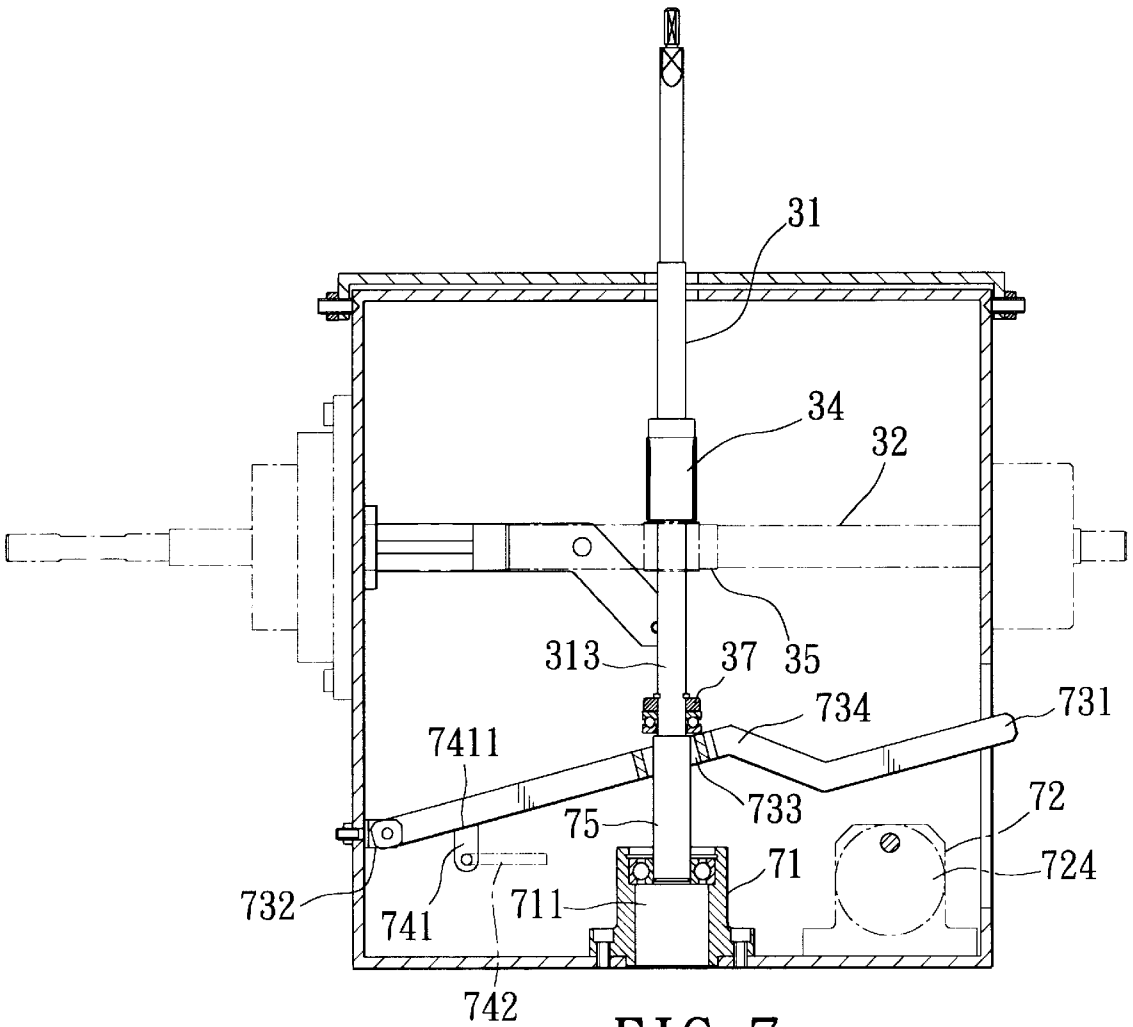
FIG. 7 is a view similar to FIG. 5 but showing the preferred embodiment in a state where an upright shaft is disengaged from a transmitting shaft.

Referring to FIGS. 4, 5 and 7, a clutch member 74 includes a plate 741 and a handle 742 which is mounted on an end of the plate 741. The plate 741 has an opposite end 7411 which abuts against the weight portion 734 between the fulcrum end 732 and the through hole 733. As such, turning of the handle 742 can bring the opposite end 7411 to thrust the weight portion 734 upwardly so as to raise the lifted segment 313 beyond the higher position, thereby disengaging the coupled segment 34 of the upright shaft 31 from the coupling segment 35 of the transmitting shaft 32, as shown in FIG. 7. In this state, the drive force of the output shaft 331 cannot be transmitted to the upright shaft 31. Thus, when the third rotary woodworking member 40 is not to be used, the handle 742 can be operated so that rotation of the transmitting shaft 32 cannot be transmitted to rotate the upright shaft 31.

By means of the linear motion stabilizing member 71, the plunger 75 and the lifting force receiving member 37 which extend along the upright axis, the reciprocating movements of the upright shaft 31 can be smooth and steady. In addition, since three rotary woodworking members 50,60,40 can be mounted on the support frame 20 to be driven by the output shaft 331 of the motor 33, the rotary woodworking machine of this invention can perform various woodworking operations.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

We claim:

1. A rotary woodworking machine comprising:

a linear motion stabilizing member including top and bottom ends opposite to each other in an upright direction to define a guideway therebetween;

a plunger disposed to be slidable along said guideway between higher and lower positions, and having an upper end proximate to said top end;

an upright shaft with an upright axis in the upright direction, said upright shaft including a lower anchoring portion which is mounted to and which is rotatable relative to said upper end about the upright axis, an intermediate portion which extends uprightly from said lower anchoring portion and which has lifted and coupled segments respectively proximate to and distal from said lower anchoring portion, and an upper mounting portion which extends uprightly from said coupled segment;

a lifting force receiving member having a pushed end which is disposed proximate to said lower anchoring portion and which permits said lifted segment to be rotatable relative thereto, and a securing end which is opposite to said pushed end in the upright direction, and which is rotatable relative to said pushed end so as to be rotated with said lifted segment;

a support frame;

a motor with an output shaft for delivering a drive force;

a lifting lever including a fulcrum end pivotally mounted on said support frame about a pivot axis transverse to the upright axis, a force end opposite to said fulcrum end, and a weight portion interposed between said fulcrum end and said force end;

a cam member coupled to said output shaft and said force end of said lifting lever such that the drive force of said output shaft is transmitted to said force end to effectuate reciprocating upward and downward movements of said force end in the upright direction, and such that upward movement of said force end will cause said weight portion to push against said pushed end so as to lift said lifted segment as well as said plunger from the lower position to the higher position; and a transmitting shaft journalled on said support frame, and disposed to be driven by the drive force so as to rotate about a first axis which is transverse to the upright axis and the pivot axis, said transmitting shaft including a coupling segment to couple with said coupled segment such that rotation of said transmitting shaft is transmitted to rotate said coupled segment when said lifted segment is moved between the lower and higher positions.

2. The rotary woodworking machine of claim 1, wherein said lifting force receiving member is a bearing which has lower and upper races that serve as said pushed end and said securing end, respectively.

3. The rotary woodworking machine of claim 1, wherein said cam member includes a cam wheel which is rotatable about a second axis parallel to the pivot axis, and a cam follower which is disposed on said force end and which is guided by said cam wheel to perform reciprocating movements, said machine further comprising a coupling gear unit disposed to transmit the drive force to rotate said cam wheel about the second axis.

4. The rotary woodworking machine of claim 3, wherein said coupling gear unit includes a worm gear which is disposed on and which is rotated with said output shaft, a rotating shaft which extends along the second axis and which has first and second shaft ends, and a toothed wheel which is mounted on said first shaft end and which meshes with said worm gear to rotate said rotating shaft about the second axis, said cam wheel being mounted on said second shaft end so as to be rotated with said toothed wheel about the second axis.

5. The rotary woodworking machine of claim 1, wherein said coupled and coupling segments respectively have outer threaded surfaces formed thereon to frictionally engage each other such that the rotation of said transmitting shaft is transmitted to rotate said coupled segment.

6. The rotary woodworking machine of claim 4, further comprising a clutch member which is disposed adjacent to said weight portion of said lifting lever and which is operable to thrust said weight portion of said lifting lever upwardly so as to raise said lifted segment beyond the higher position, thereby disengaging said coupled segment from said coupling segment.

7. The rotary woodworking machine of claim 1, wherein said transmitting shaft has first and second ends disposed opposite to each other in the first axis and extending outwardly of said support frame, said machine further comprising first and second rotary woodworking members which are coupled to and which are rotated with said first and second ends, respectively.

8. The rotary woodworking machine of claim 1, further comprising a third rotary woodworking member which is coupled to and which is rotated with said upper mounting portion.

9. The rotary woodworking machine of claim 1, further comprising an anti-friction bearing disposed between said linear motion stabilizing member and said plunger.

* * * * *